United States Patent [19]

Harris

[11] Patent Number: 4,945,581

[45] Date of Patent: Aug. 7, 1990

[54] FLUSH TANK WATER SAVER

[76] Inventor: John L. Harris, 470 Palm Island NE., Clearwater, Fla. 34630

[21] Appl. No.: 319,263

[22] Filed: Mar. 6, 1989

Related U.S. Application Data

[63] Continuation of Ser. No. 30,080, Mar. 26, 1987, abandoned.

[51] Int. Cl.[5] ..... E03D 1/14

[52] U.S. Cl. ..... 4/325; 4/415

[58] Field of Search ..... 4/324, 325, 415, 381, 4/382, 383, 384

[56] References Cited

U.S. PATENT DOCUMENTS

| | | | |
|---|---|---|---|
| 466,828 | 1/1892 | Lipp | 4/382 |
| 2,532,977 | 12/1970 | White | 4/325 |
| 3,026,536 | 3/1964 | Wood . | |
| 4,032,997 | 7/1977 | Phripp et al. | 4/325 |
| 4,135,261 | 1/1979 | Overbey | 4/325 |
| 4,216,555 | 8/1980 | Detjen | 4/325 |
| 4,305,163 | 12/1981 | Raz | 4/325 |
| 4,391,003 | 7/1983 | Talerico et al. | 4/381 |
| 4,483,024 | 11/1984 | Troeh | 4/324 |
| 4,651,359 | 3/1987 | Battle | 4/381 |
| 4,811,432 | 3/1989 | Harris | 4/325 |

*Primary Examiner*—Linda J. Sholl

[57] ABSTRACT

A flush tank water saver has an elongated semi circular base fitting around and clamped to the overflow pipe. This base carries an operating lever on pivots close to the flapper valve pivots. This lever engages the flapper valve at its center and pushes it in exactly the direction it is going, eliminating friction losses. The lever is operated to push the valve closed by a float mounted on the other side of the overflow pipe on a vertical guide. The float operates a float lever connected to the valve operated by a link. A stop for the float is brought into place by the flush lever. If the user holds the flush handle down for two seconds the float engages the stop and is inoperative for that flush. This provides a full flush.

19 Claims, 2 Drawing Sheets

FIG. 1
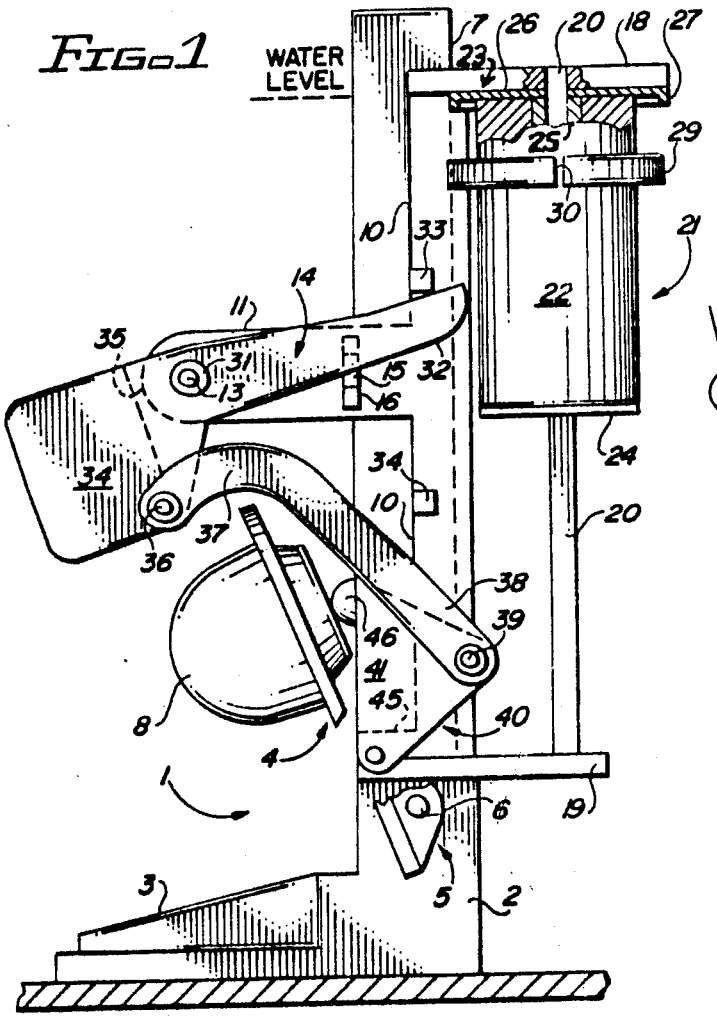
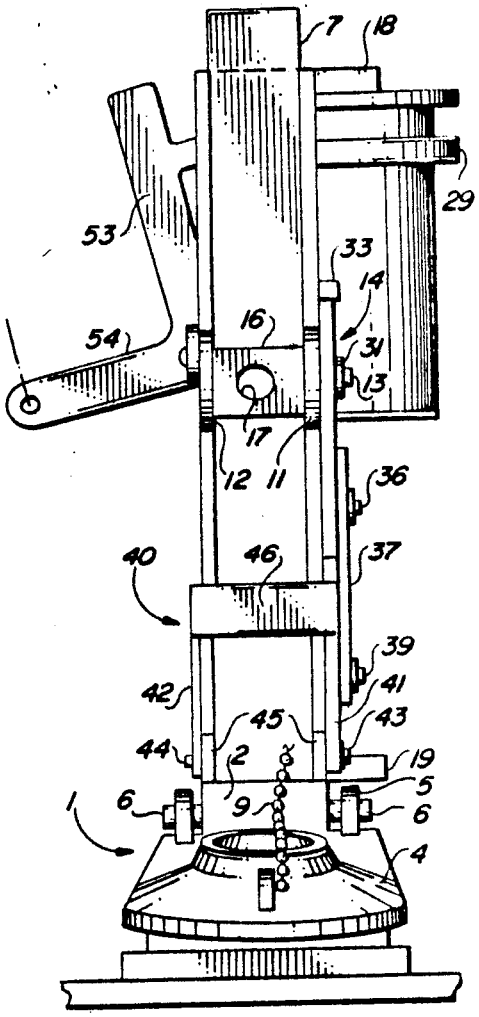
FIG. 2
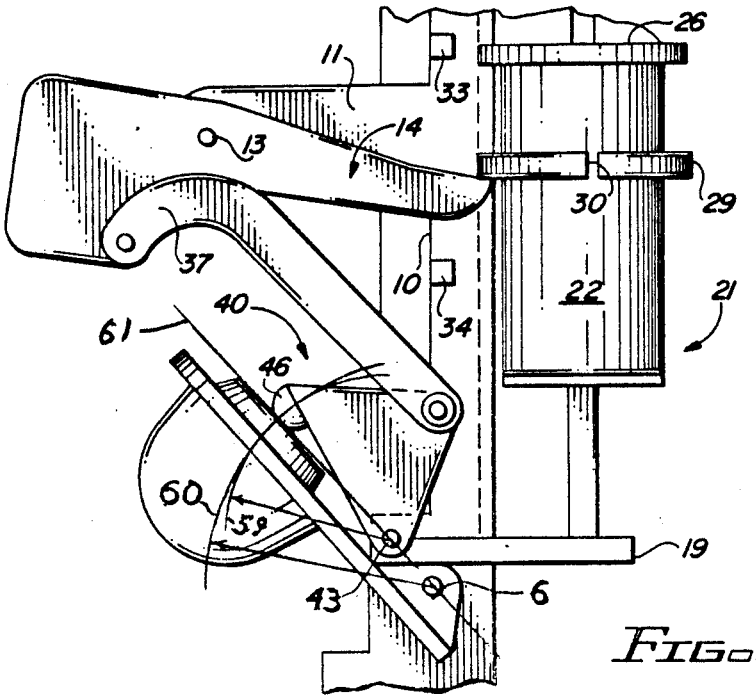
FIG. 3

FLUSH TANK WATER SAVER

BACKGROUND OF THE INVENTION

This application is a continuation of my application Ser. No. 07/030080 filed Mar. 26, 1987 now abandoned.

This invention relates to toilet tank controls for selectively providing a water saving short flush or a full flush.

It has long been recognized that toilet flush tanks are one of the worst water wasters in existence. They are flushed often and each time use a full tankful even though less than half would give an adequate flush for most uses.

Many attempts have been made to develop suitable devices giving the user a choice between a short flush or a full flush. To date, in spite of the demand for water saving, none is on the market. In these devices an extra float is used for pushing the tank flush valve closed before the tank is empty. In the older patents, the float pushes a ball valve straight down. In the newer patents, the float moves straight down and pushes at an angle on the back of the new type pivoted float-flapper valve. These flapper valves are made of a very soft and flexible rubber. Pushing at an angle involves considerable friction loss and the inherent "wobble" of the soft rubber, plus rubbing over trademark raised characters on the flapper valve gives inconsistent results.

SUMMARY OF THE INVENTION

The present invention is a unitary device that slips over the overflow tube of a flush tank and is held in place by a thumb screw. It includes a pivoted flapper valve operator engaging in what is the back of the flapper valve when open. This engagement is at the center of the valve and extends over a substantial area, minimizing the "wobble" effect of the soft rubber.

This lever pushes the flapper valve in the same direction it is going, eliminating friction. It is rocked by a vertically guided float on the other side of the overflow tube and pushes the flapper valve closed when the water level is about half way down.

Provision for a full flush is obtained by a latch for holding the float up. This latch is moved into latching position by the flush lever. For a full flush the user holds the flush lever down until the float drops to engage it, (about 1½ to 2 seconds).

The primary object of the present invention is to provide a simple, low cost and dependable unit that may be successfully attached to existing flush tanks by unskilled persons.

A further object of the invention is to provide a simple adjustment requiring no tools for adapting the device to installations of varying characteristics.

Other objects will appear from the following detailed description and appended claims.

BRIEF DESCRIPTION OF THE DRAWINGS

FIG. 1 is a front elevation of the water saver with the parts in the positions assumed at the start of a flush.

FIG. 2 is an end view of FIG. 1 showing the parts in the positions assumed when the tank is full before a flush.

FIG. 3 is a fragmentary view similar to FIG. 1 but showing the parts in the positions at approximately the end of a short flush.

DETAILED DESCRIPTION

Figure 4:
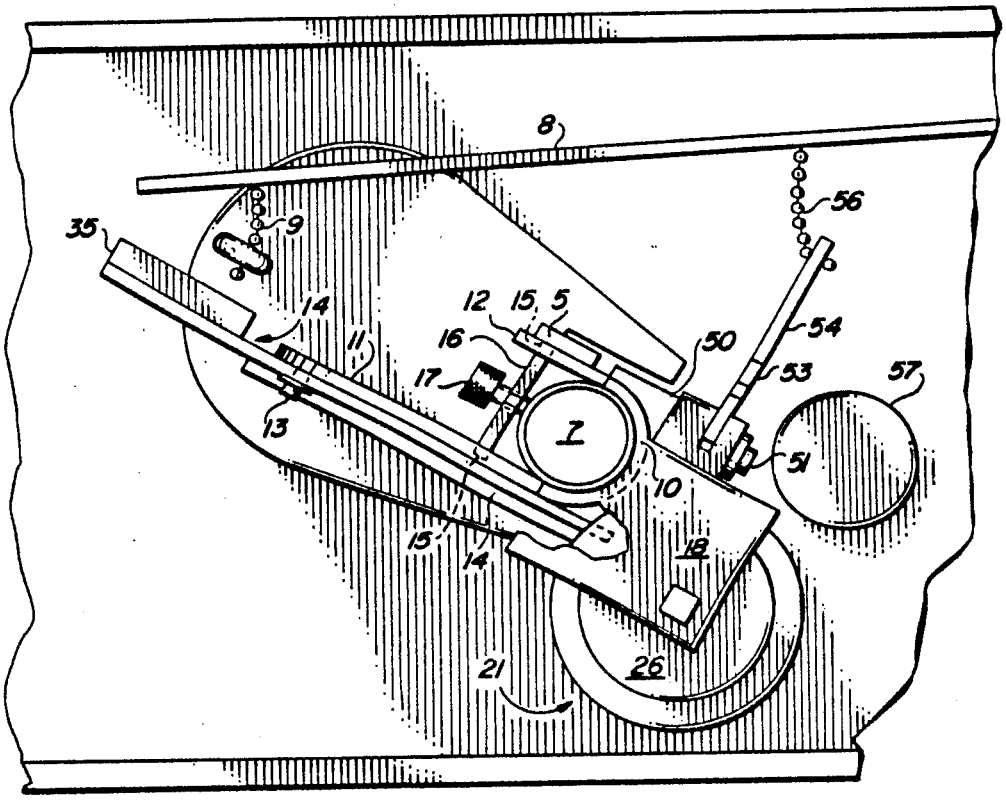
FIG. 4 is a top view showing the installation in a typical flush tank.

Referring to FIGS. 1 and 2, reference character 1 indicates generally the outlet valve mechanism of a typical modern flush tank. This includes a base member 2 having an outlet valve port 3 normally covered by a float type flapper valve 4. As usual, this flapper valve is provided with ears 5 on both sides of the base pivotally mounted to support 6 formed on the base. This part of base 2 having supports 6 is part of an overflow pipe means including an overflow pipe 7 extending above the water level indicated. The flapper valve 4 is operated by a flush lever 8 (FIG. 4) which is connected to the valve by a chain 9. When the flush lever 8 is moved upward by an external flush lever (not shown) it pulls the flapper valve 4 from its seat and the float portion 8 causes it to move to the wide open position of FIG. 1. When the water level drops below float 8, the flapper valve rotates about its pivots and falls into its closed position of FIG. 2. The part so far described is standard equipment in typical flush tanks.

The invention to be described is an attachment that may be easily installed in existing flush tanks. This attachment includes an elongated molded plastic semi-circular base 10 fitting around the right side of the overflow pipe 7 as seen in FIGS. 1 and 4. This semi-circular base is open on one side providing a rigid channel-like construction that can easily be fabricated. Near the middle of the base are two extensions from the semi-circle, 11 and 12 (FIG. 4). Extension 11 extends a substantial distance from the overflow tube 7 and carries a pivot pin 13 supporting a float lever 14. Extension 12 is shorter as shown in FIG. 4. Extensions 11 and 12 have slots as at 15 which support a mounting clamp 16 carrying a knurled set screw 17. This set screw firmly holds the semi-circle base against the overflow tube 7. It should be noted that the curved engagement surfaces at the ends of the base member 10 are spaced axially on the overflow pipe and hold the base 10 parallel with the overflow pipe. The single clamp 7 engages the overflow pipe on the side opposite the curved surfaces at a point axially spaced between the surfaces and pulls both of those surfaces into contact with the pipe.

The semi-circle base member 10 has integral float supports 18 and 19 at its upper and lower ends. These are in vertical alignment and support a square float guide rod 20 supporting a cylindrical float 21. This guide means 20 allows float to move up and down substantially parallel with the overflow pipe 7.

The float 21 may be formed of a cylindrical mid-portion 22 of soft light material such as foam plastic. It has molded end portions 23 and 24 of wear resistant material such as DELRIN # which engage the guide 20. As shown in FIG. 1 the top end piece 23 has a guide portion 25 extending into the cylindrical section and engaging rod 20. It also has a flat section 26 extending outwardly beyond the cylindrical section 22 and has a down turned edge portion 27. The purpose of this construction will appear later.

The float 21 also includes a vertically adjustable ring 29 mounted on the cylindrical mid-portion 22. The ring is molded of a suitable wear resistant material such as DELRIN # with a split 30. It is molded with a diameter slightly less than cylinder 22 and the split 30 allows it to expand for a friction fit on the float. The lower surface of ring 29 is thus a vertically adjustable contact surface on the float for actuating the float lever 14.

This float lever is pivotally mounted on stud 13 supported by base 10 and is held in place by a retainer 31. The float operated end 32 extends past the overflow pipe 7 to a position, under the float ring 29 and has its travel limited by an upper stop 33 and a lower stop 34 molded on base 10. The operating end of lever 14 is enlarged as at 34 and carries a weight 35 (FIG. 4) for biasing it in a counterclockwise direction against upper stop 33. This float lever also is formed with a stud 36 pivotally supporting a link 37 extending over the flapper valve operator generally indicated as 40.

This operator has two leg portions 41 and 42 pivotally mounted on studs 43 and 44 supported by extensions 45 on base 10. The studs are near pivots 6 for the flapper valve. The legs 41 and 42 are connected by a flapper valve operating portion 46 extending across base 10 behind the center of flapper valve 4. When it is in open position as shown in FIG. 1, it will be apparent that when the float lever 14 is rocked clockwise by downward movement of the float, the operating means consisting of lever 14, link 37 and operator 40 will push the flapper valve 4 toward closed position. It will also be apparent that the float and flapper valve are on different sides of the overflow pipe. The float is adjacent the overflow pipe and moves in a path parallel with the pipe in an area spaced laterally from the flapper valve.

As will be explained in detail under "OPERATION", the mechanism described above will provide a water saving short flush. To get a full flush, the user would have to hold the flush handle down until the tank empties. This would not be acceptable commercially. The invention further includes a means involving no changes in the flush tank for giving the user a quick choice between a short flush and a full flush. This will now be described referring to FIGS. 4 and 5.

Figure 5:
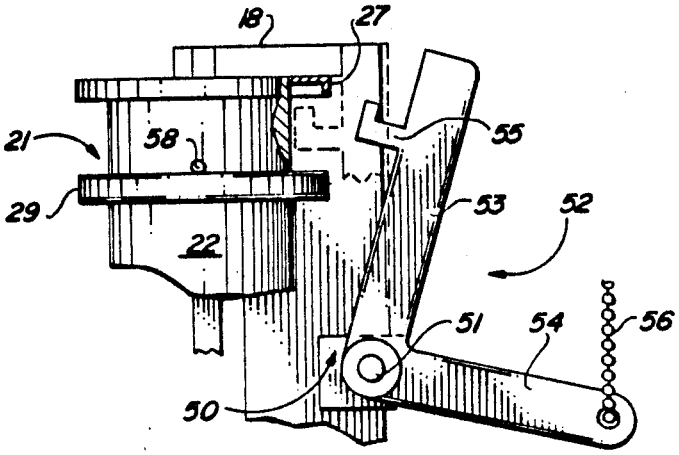
FIG. 5 is a fragmentary end view at the opposite end from FIG. 2, showing the arrangement providing a full flush.
Figure 6:
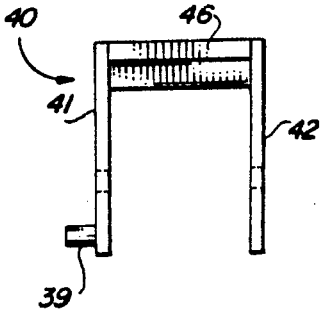
FIG. 6 is a top view of the flapper valve operator shown in the position of FIG. 3.

Molded integrally on base 10 is a boss 50 having a long stud 51. This stud carries a locking means for the float consisting of a bell crank lever 52 having arms 53 and 54. Arm 53 carries a float locking portion 55 extending inwardly and then upwardly. Arm 54 extends to the right as shown in FIG. 5 and is connected by a chain 56 to the flush lever 8 which also operates the flapper valve (FIG. 4).

INSTALLATION

Installation is made by the purchaser in four easy steps.

1. Close the inlet valve to tank and flush to empty tank.
2. Slip the unit on the overflow pipe down as far as it will go to its fixed location against the top of base 2. Aim screw 17 at the center of the flapper valve as shown in FIG. 4 and tighten. All of the parts are clear of the tank filler pipe 57.
3. Hold the external flush lever down against its stop, take slack out of chain 56 and attach it to lever 8.
4. Adjust the inlet float valve to set the water level at the top of the float as indicated.

OPERATION

FIG. 2 shows the parts in normal inactive position. The flapper valve is closed, the flush tank is full and the float is at its top position pressing against float support 18. This float is designed with a buoyancy to cause it to extend about 1" above the water level when free. The flush lever is in its down position allowing slack in flapper valve chain 9 and bell crank chain 56. The bell crank or control means 52 is in the full line position of FIG. 5, (first mode) causing its locking portion 55 to be out of the downward path of the float.

When a partial flush is desired, the user presses on the external flush lever and releases quickly. The bell crank 52 is first rotated to its dotted line float locking position (second mode) and then allowed to retract out of the path of the float. This same upward motion of flush lever 8 pulls the flapper valve off its seat and the flapper valve due to the buoyancy of float 8 opens to the position of FIG. 1. Its top center presses against bar 46 of the operator 40.

The water level starts dropping rapidly. It will drop the first inch in about 1¼ seconds at which time the float starts moving down. This allows time for the user to release the flush lever and for bell crank 52 to rotate out of the way.

The float will continue dropping and ring 29 will engage float lever 14 causing it to rock clockwise about its pivot 13. This causes movement of link 37 to the left, rotating flapper valve operator 40 counterclockwise about its pivot pins 43 and 44. When the parts reach the approximate positions shown in FIG. 3, the exposure of the top of the flapper valve to the down rushing water will create a downward force sufficient to overcome the buoyancy of float 8. The flapper valve will now snap closed. The water level at which this occurs may be adjusted by moving ring 29 up or down on the float. The ring in FIG. 5 is shown in its top-most position where adjustment is stopped by a stop pin 58.

When a full flush is needed, the user holds the flush handle down about two seconds. The float locking portion 53 of bell crank 52 will still be in the dotted line locking position shown in FIG. 5 when the float drops. This will stop the float from dropping. The upward extension on locking portion 53 is behind the downward lip 27 on the float. This holds the locking lever in locking position until the tank refills causing the float to rise and release lever 52. The arrangement just described renders the float inoperative by the conjoint action of the float and flush lever. As the float is now inoperative, the regular flushing mechanism will go through a full flush.

The arrangement in which the flapper valve operator is pivotally mounted near the flapper valve pivots provides for almost frictionless driving of the flapper valve by the operator. Referring to FIG. 1, arc 59 is the path traveled by the point of contact of crossmember 46 of the valve operator with the flapper valve. Arc 60 is the path traveled by the point of contact on the flapper valve with the operator. It should be noted these two paths of travel practically coincide through the operating range of the operator 40. This operating range is approximately from the position of crossmember 46 shown in FIG. 1 to that shown in FIG. 3. These coinciding paths eliminate friction loss and make the action of float 21 more effective and accurate. The arrangement of the operator crossover bar 46 extending across the flapper valve avoids distortion of this soft rubber part. This further contributes to accurate and consistent operation.

The basic reason the two paths of travel substantially coincide through the operating range of the operator is the location of the operator pivots 43 and 44 relative to the valve pivots 6. As shown in FIG. 3, the operator pivots 43 and 44 are in the area of a line from the valve pivots 6 through the area of contact of the operator and valve when the operator is pushing the valve to closed position.

To show this relationship more clearly, an imaginary line 61 is included in FIG. 3 and goes from the center of valve pivot 6 through the point of contact of operator bar 46 with the valve. The operator pivot 43 is in the area of this line and the two paths practically coincide.

I claim:

1. A water saver control for a toilet flush tank having an outlet, an overflow pipe means, a flapper valve mounted on pivots on the overflow pipe means and an externally operated flush lever connected to the flapper valve for opening same on upward movement of the flush lever to flushing position, the combination of, a float adjacent the overflow pipe means in an area spaced laterally from that occupied by the major portion of the flapper valve, said float being located vertically so as to be operative to close the flapper valve at an intermediate water level in the tank, guide means for the float supported by the overflow pipe means, said guide means being constructed and arranged to allow up and down movement of the float substantially parallel with the overflow pipe means, pivotally mounted operating means for the flapper valve, said operating means having a float engaging portion and a flapper valve engaging portion, said operating means being constructed and arranged to cause movement of the flapper valve toward closed position on downward movement of the float.

2. The combination recited in claim 1 in which the operating means includes a lever pivotally supported by the overflow pipe means, having a first part on one side of the overflow pipe means actuated by said float and a second part on the other side of the overflow pipe means controlling the flapper valve.

3. The combination recited in claim 1 including means controlled conjointly by the float and the flush lever for rendering the float inoperative when the float drops to a predetermined level while the flush lever is held in flushing position.

4. The combination recited in claim 2 in which the second part of the lever transmits force for pushing the flapper valve toward closed position.

5. The combination recited in claim 2 in which the float is provided with a vertically adjustable contact surface for actuating said lever.

6. The combination recited in claim 2 in which the flapper valve is pushed toward closed position by an operator pivotally mounted on the overflow pipe means near the pivots for the flapper valve.

7. The combination recited in claim 6 in which the pivot mounts for the flapper valve and operator are arranged to cause the points of contact between the flapper valve and operator to travel in substantially coinciding paths through the operating range of the operator.

8. The combination recited in claim 5 in which the float is cylindrical with its axis vertical and the adjustable contact surface is on a ring held by friction to the outside of the float.

9. A water saver control for a toilet flush tank having an outlet, an overflow pipe means, a valve for closing the outlet, an externally operated flush lever connected to the valve for opening same on movement of the flush lever upwardly to an upper position and means for closing the valve when the tank is substantially empty, the combination of, water saver means arranged to close the valve when the water drops to an intermediate level, said water saver means including a float adapted to be mounted in said tank for movement with the water level, first linkage means responsive to downward movement of said float for actuating said valve to a closed position, control means for the water saver means having a first mode and a second mode, the first mode being arranged to allow movement of said float for closure of the valve of said intermediate level and the second mode being arranged to prevent substantial movement of said float to prevent closure of the valve at said intermediate level to provide a full flush, second linkage means between the flush leer and said control means arranged to hold the control means in its second mode and prevent substantial movement of said float when the flush lever is held in its upper position, said second linkage means and control means being constructed to allow return of the control means to its first mode when the flush lever is lowered, locking means for the control means constructed to have an unlocked condition in which it allows the control means to return to its first mode and allows movement of said float when the flush lever is lowered and a locking condition in which it locks the control means in its second mode and prevents substantial movement of said float to cause full flush, said float being arranged to remain in the water at the start of a flush and to follow downward movement of the water level as the flush progresses to actuate said first linkage means, and said locking means being means activated by said float on initial drop of water level when the control means is in its second mode for changing the locking means from its unlocking condition to its locked condition.

10. The combination recited in claim 9 in which the water saver mean sis rendered inoperative by means holding the float.

11. The combination recited in claim 9 in which the locking means includes a bell crank lever pivotally mounted below a portion of the float, said lever having one arm for engaging and holding the float and another arm extending toward the flush lever and being operated thereby.

12. The combination recited in claim 9 in which the control means is separate from the water saver means and is movable between its first and second modes by the linkage means independently of the float.

13. A water saver attachment for a toilet flush tank having an outlet base member, including an outlet, an overflow pipe attached to and carried by the outlet base member, a valve for the outlet supported by the base member, and an externally operated flush lever connected to the valve for opening same on upward movement of the lever, said valve being of the type which holds itself open due to its buoyancy until the tank is empty, the combination of, an elongated rigid water saver base having axially spaced apart engaging portions engaging one side of the overflow pipe and constructed to hold said base parallel with the pipe, said base being formed with an elongated opening on one said providing a channel like construction, clamping means engaging the side of the overflow pipe opposite from said engaging portions for pulling the base against the overflow pipe in a fixed location, water saver means including valve operator means movably mounted on said base and arranged to contact the valve to push it toward closed position against its buoyancy on movement of the operator means in one direction, float means movably mounted on said base, means including the float means for moving the operator means in said direction in response to falling water level, and wherein said elongated base is sized such that when mounted on said overflow pipe, it has a lower end which contacts said outlet base member and said valve operator means is aligned in proper position to operate said valve.

14. The combination recited in claim 13 in which the water saver means is normally operative and is rendered inoperative by means controlled conjointly by the float and flush lever when the water level drops to a predetermined level while the flush lever is held in its valve open position.

15. The combination recited in claim 13 in which the valve is of the pivoted flapper-float type and the operator means is a lever mounted on pivot means on said base.

16. The combination recited in claim 13 in which the clamping means is a single clamping means located axially between the engaging portions forcing both engaging portions into engagement with the overflow pipe.

17. The combination recited in claim 14 in which the flapper valve and operator means are arranged to cause the points of contact between the flapper valve and operator means to travel in similar general directions through the operating range of the operator means.

18. The combination recited in claim 15 in which the pivot means consists of two pivots on opposite sides of the base member and in which the lever has two legs, one on each pivot, and a crossmember extending across the base member from one leg to the other, said crossmember being constructed and arranged to contact the flapper valve.

19. The combination recited in claim 17 in which the top of the elongated base indicates the proper water level in the tank to work with the water saver.

* * * * *